United States Patent [19]

Young, IV et al.

[11] Patent Number: 4,573,685

[45] Date of Patent: Mar. 4, 1986

[54] GOLF CLUB HEAD WITH TRANSPARENT STRIKING FACE

[75] Inventors: Henry N. Young, IV; Richard C. Smith, both of Pittsburgh, Pa.

[73] Assignee: Banff Golf Company, Inc., Pittsburgh, Pa.

[21] Appl. No.: 651,926

[22] Filed: Sep. 19, 1984

[51] Int. Cl.[4] ..... A63B 53/04; A63B 53/08

[52] U.S. Cl. ..... 273/173; 273/171; 273/183 D; 273/183 E; 273/167 E; 273/DIG. 14

[58] Field of Search ..... 273/173, 174, 167 J, 273/171, 169, 167 E, 183 D, 183 E, 193 R, 163 R, 164, DIG. 14

[56] References Cited

U.S. PATENT DOCUMENTS

| | | | |
|---|---|---|---|
| 3,019,022 | 1/1962 | Ehmke | 273/173 X |
| 3,126,206 | 3/1964 | Sabia | 273/193 R X |
| 3,134,596 | 5/1964 | Boznos | 273/173 |
| 3,888,492 | 6/1975 | Cabot | 273/173 X |
| 3,970,236 | 7/1976 | Rogers | 273/173 X |
| 4,121,832 | 10/1978 | Ebbing | 273/173 X |
| 4,199,144 | 4/1980 | Skelly | 273/167 J X |

FOREIGN PATENT DOCUMENTS

| | | | |
|---|---|---|---|
| 827567 | 1/1938 | France | 273/167 J |

*Primary Examiner*—George J. Marlo

*Attorney, Agent, or Firm*—Stoll, Wilkie, Previto & Hoffman

[57] ABSTRACT

A golf club head construction in which the head is transparent from front to back, over at least a major portion of the face of the head, the transparent portion being surrounded on at least three sides with a structure which supports, or is integral with, the transparent portion. The supporting structure in the preferred embodiment comprises the toe, sole and heel of the head which in conjunction with each other comprise a generally U-shaped recess for the transparent section. The transparent section is removably insertable into the U-shaped supporting recess and is positioned therein by complimentary configurations such as parallel opposed tongue-and-groove side members and a cooperating tongue-and-groove bottom member. The supporting structure may be formed of a single piece of material having a density sufficient to provide conventional and proper weight and balance to the club, such as a non-transparent metal, or the supporting structure may be comprised of a plurality of separable elements individually positionable or removable for balance and weight adjustments. To facilitate change between a single-piece supporting structure or a multiple-section supporting structure, a hollow receiving cover may be used to enclose all portions, including the transparent section. The cover is preferably made of a transparent material, at least at the portion covering the transparent section of the head.

6 Claims, 8 Drawing Figures

Fig. 1.
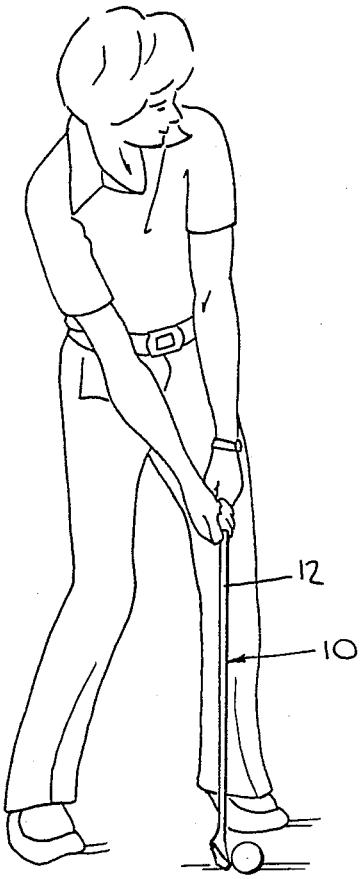
Fig. 2.
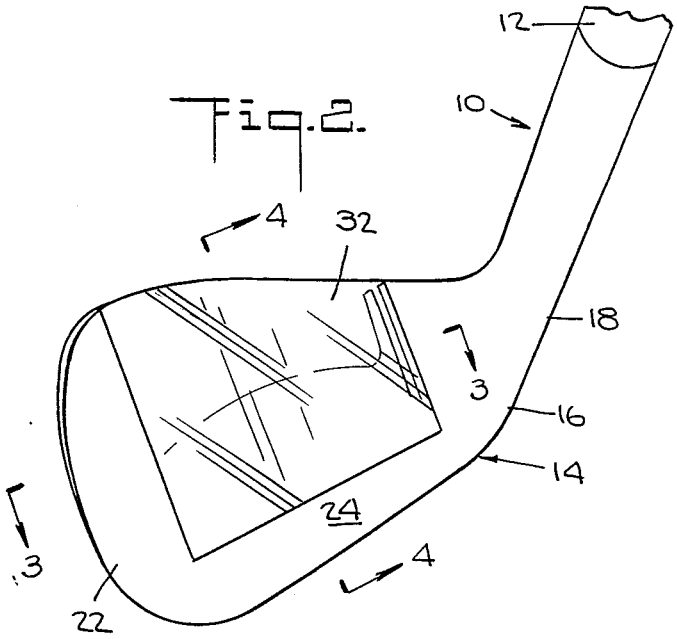
Fig. 3.
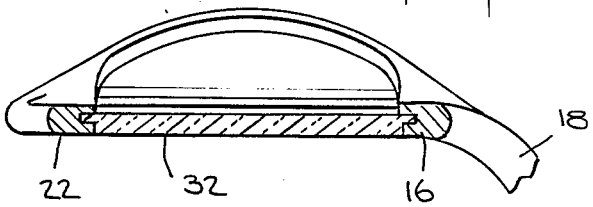
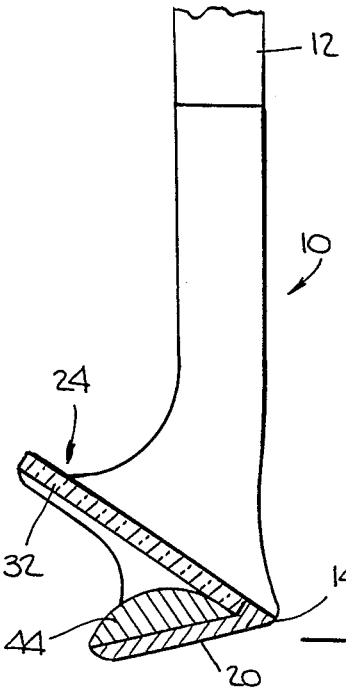
Fig. 4.
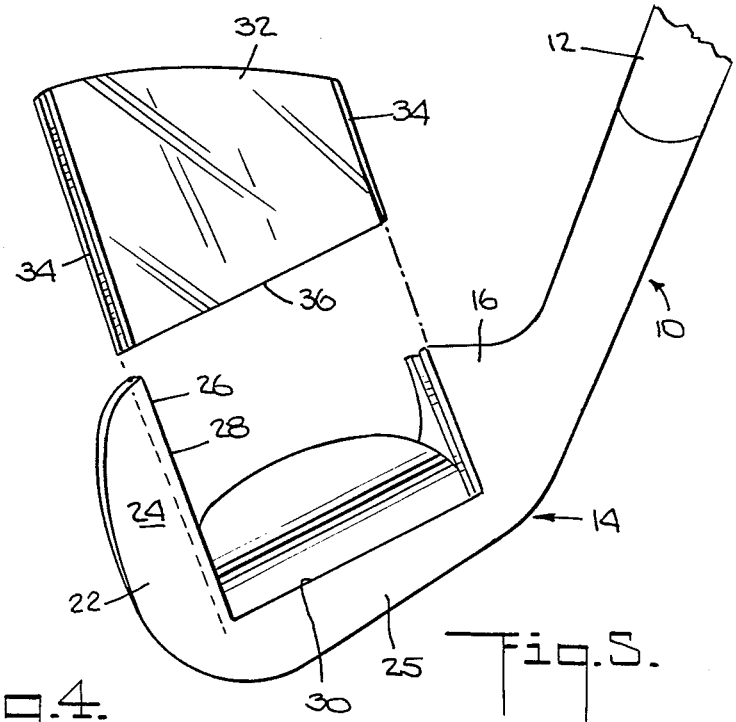
Fig. 5.

GOLF CLUB HEAD WITH TRANSPARENT STRIKING FACE

TECHNICAL FIELD

Sports training and playing implements for golfers, particularly sand/pitching wedge clubs and irons for use in golf.

REFERENCE TO RELATED DOCUMENTS

Reference is made to Ser. No. 120,706, filed in the U.S. Patent and Trademark Office on Sept. 22, 1983, the benefit of such date being claimed herein for all material disclosed in said disclosure document.

BACKGROUND OF THE INVENTION

While many designs for transparent golf club heads are known, they are principally, although not entirely, of a mirror-type arrangement or some other configuration which is not transparent fully front to back of the head. Additionally, little provision is known in the prior art for making the transparent section replacable or providing sufficient weighted sections of the head in the proper locations for proper balance, or a combination of these features whereby the transparent section is replacable, securable into a weighted supporting structure and the supporting structure may either be a fixed weight balancing configuration or adjustable. In particular, the following represent the closest known structures to the inventors in the prior art:

| Patent No. | Name | Patent Date |
|---|---|---|
| 1,327,171 | Ruggles | January 6, 1920 |
| 2,463,798 | Paisley | March 8, 1949 |
| 3,019,022 | Ehmke | January 30, 1962 |
| 3,043,596 | Ehmke | July 10, 1962 |
| 3,403,912 | Maroun | October 1, 1968 |
| 3,421,765 | Scott | January 14, 1969 |
| 3,873,094 | Sebo et al | March 25, 1975 |

SUMMARY OF THE INVENTION

The invention is with respect to the type of golf clubs known generally as sand wedges, pitching wedges and irons. The purpose of the invention is to aid the non-expert golfer in improving his play, particularly sand play, by focusing his attention to the sole of the club head and the sand beneath it, rather than to the face of the club and the ball, by allowing him to see through the transparent portion of the face. Because the sand shot is the only shot in golf in which the face portion of the club head does not make direct contact with the ball, and because of the importance of understanding the function of the sole of a sand wedge for proper execution of the shot, a normal non-transparent metal face is not necessary and, in fact, a transparent insert will allow the golfer to see that part of the club head with which he should be specifically concerned. Additionally, because the importance of the leading edge of the bottom of the face of a conventional golf club, such as in a pitching application, the transparent insert is a teaching aid, particularly when removed.

The invention provides that a large portion, at least 75% of the face of the club head, which is normally made of forged iron or stainless steel, will be eliminated and replaced by a totally clear see through material. The clear replacement material will either be shatter-proof glass or some other plastic or synthetic material that is non-breakable and transparent. The remaining portion of the club head, comprised of the toe, heel, sole and neck portions, will be made of heavier, more conventional material, such as iron or stainless steel, with the addition of a heavier-than-standard metal material, such as tungsten, for weight and balance purposes.

The transparent insert will have a configuration corresponding to the normal configuration of that portion of the conventional golf club head, with the preferred omission of grooves from the face if those grooves will obstruct transparency, and the remaining portion of the club head, of metal, is formed in a generally U-shaped configuration to receive the transparent insert in removably secure position. Tongue-and-groove or like configurations cooperate between the transparent insert and the U-shaped supporting member.

Provision is made for adding weight to the club head to compensate for the generally lighter weight transparent portion so that the complete head, including the transparent portion and extra weighted portion, will correspond as closely as possible to the weight of a conventional sand/pitching wedge. However, because of the placement of the additional compensating weight, there is a beneficial and improved redistribution of the weight of the sand wedge of the present invention as compared to conventional sand/pitching wedges. Moreover, because the weight and shape of the compensating weight can be varied, adaptation to newer club designs, such as featherweight designs, can easily be accomplished.

Moreover, the sand wedge of the present invention may be advantageously employed without its transparent insert as an effective training club for normal golf shots off the ground since there is sufficient face material beneath the removed insert for a golf ball to be properly hit if correct technique is employed.

Still further, a unique cover supporting means may be used to encapsulate and support the head of the present invention and to permit the supporting member to be either a single piece for fixed weight or multiple-sectioned for adjustability of weight and balance.

DESCRIPTION OF THE DRAWING

FIG. 1 is an illustrative front pictorial view of a sand wedge, a golf ball in cooperating registration with the sand wedge head, and a golfer in operationally cooperating control of the sand wedge.

FIG. 2 is a pictorial view of the sand wedge head of the present invention showing a single-piece metal supporting member supporting a transparent insert.

FIG. 3 is a partial cross-sectional view taken across line 3—3 of FIG. 2.

FIG. 4 is a cross-sectional view taken across line 4—4 of FIG. 2.

FIG. 5 is a view similar to that of FIG. 2, but showing an assembly of removable insert and supporting section with the removable insert being removed.

DESCRIPTION OF A PREFERRED EMBODIMENT OF THE INVENTION

Figure 6:
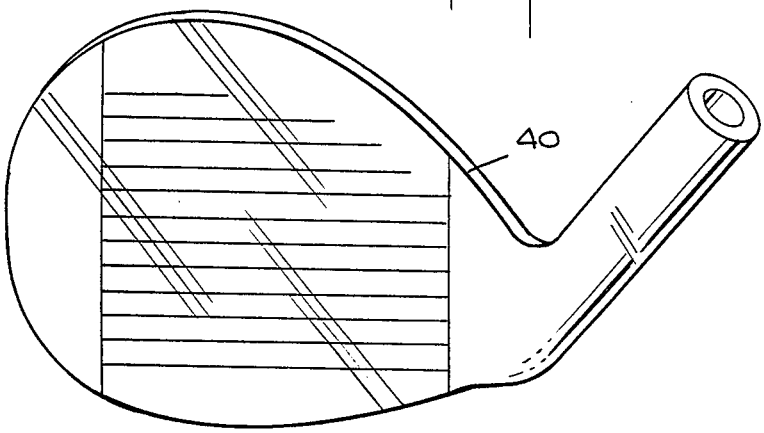
FIG. 6 is a front (face) view of the encapsulating sand wedge head cover of the present invention.

With reference to the drawing, a golf club comprises a shaft portion 12 and a head portion generally referred to as 14. The golf club is, in the preferred embodiment, a sand or pitching wedge 10, but it will be understood that the invention may be applied to other golf clubs such as irons. Head 14 is comprised of heel 16, which connects to shaft 12 by means of neck 18, sole 20 and toe 22. The front of head 14, comprising the front of heel 16 and toe 22 form a standard substantially planar face 24 which is angularly disposed from the vertical in accordance with standard sand/pitching wedge design and golfing practice.

Heel 16, the bottom portion 25 of face 24 and toe 22 define a substantially U-shaped recess 26 having substantially parallel sides 28 and a connecting bottom 30.

An insert 32, formed preferably of transparent material, is so shaped as to be slidably inserted down sides 28 to bottom 30 of U-shaped recess 26 whereby transparent insert 32 completely fills the U-shaped opening in face 24 formed by recess 26. Transparent insert 32, when fully inserted into recess 26, forms a continuum with and is a part of planar face 24.

U-shaped recess sides 28 are suitably grooved and sides 34 of transparent insert 32 have corresponding tongues, such that a slidable cooperating tongue-and-groove arrangement between each side of the insert, and each side of the U-shaped recess, provides snug retention but easy removability of the insert from head 14. An additional cooperating tongue-and-groove arrangement between U-shaped recess bottom 30, and bottom 36 of insert 32, may additionally be provided and locates and secures the insert in the head. Alternatively, V-grooves or diamond-shaped grooves may be used in place of the tongue-and-groove arrangement shown, for example, in FIGS. 3 and 5.

Insert 32 should be formed of a material that is not only transparent, but is also resistant to marring and breakage from rough handling or intentional contact with a golf ball and preferred materials include either a suitably tempered shatter proof glass, a polycarbonate material or a material such as is sold by the General Electric Company under the trademark Lexan.

Figure 7:
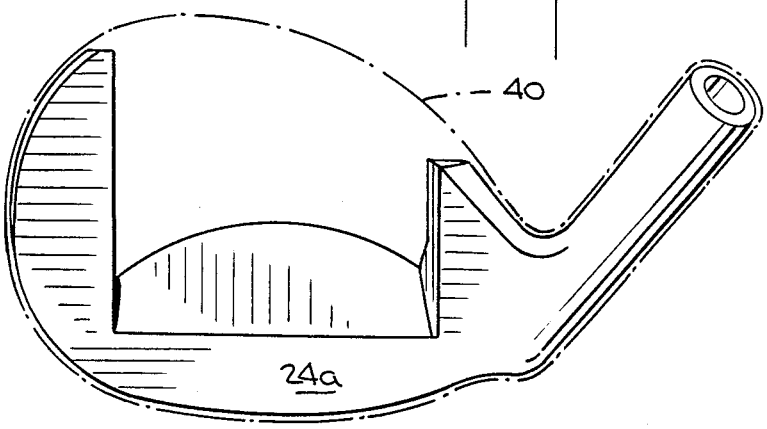
FIG. 7 is a front (face) view of a single-piece sand wedge supporting member with the encapsulating cover shown in phantom.
Figure 8:
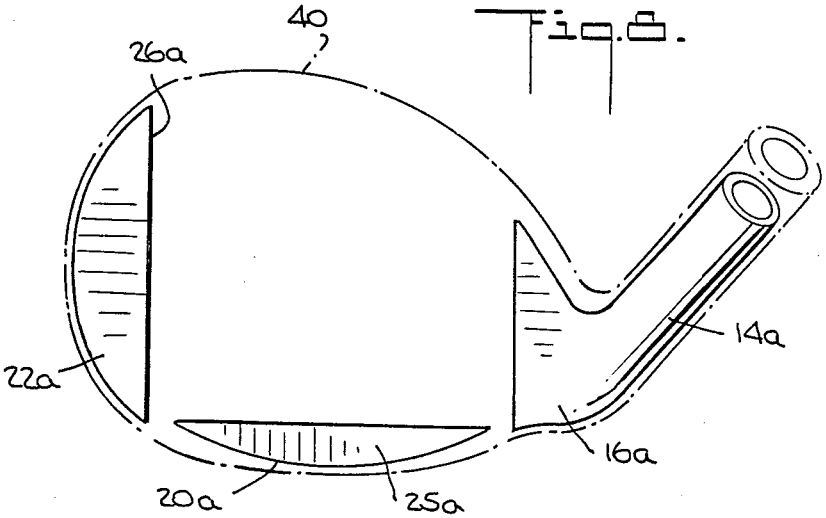
FIG. 8 is a front (face) view of a multi-sectioned supporting structure of a sand wedge head according to the present invention showing the encapsulating cover in phantom.

A cover 40 for head 14 is formed of a hollow transparent material in a shape which on the exterior corresponds generally to, although somewhat larger than, the shape of a sand wedge head 14 and on the inside defines a recess which is virtually identical to the size, shape and configuration of head 14 so that head 14 fits snugly and is retained therewithin as may be seen in FIGS. 7 and 8. Cover 40 has a bottom opening so that it may be conveniently slipped over the top of head 14 or removed therefrom.

In the conventional construction of a sand/pitching wedge head, cover 40 would have principally protective purposes. In connection with the structure of head 14 in accordance with the present invention, however, cover 40 has the additional function of retaining the parts of head 14 in place. Thus, if as shown in FIG. 7 head 14 is formed such that heel 16, bottom portion 25 of face 24, sole 20 and toe 22 are a single unitary piece, cover 40 would both protect and retain insert 32 in place in U-shaped recess 26. Additionally, it is a feature of the present invention that head **14*a* may be formed of a plurality of separable pieces, such as heel 16*a*, bottom portion 25*a* of face 24*a*, sole 20*a* and toe 22*a*, as shown in FIG. 8. In this embodiment of the invention the separable structural members forming head 14*a* are removably retained in position so as to define a substantially shaped recess 26*a* to removably receive transparent insert 32. Cover 40** is in this embodiment an important structurally unifying member as well as being protective.

It is a feature of the invention that a golfer, as shown in FIG. 1, may look vertically downwardly through transparent insert 32, to the sole 20 and to the sand beneath the club head in a sand trap. Since the golfer's eye is a distance from the club head, and since the club head is not overly large to begin with, it is an important feature of the invention that insert 32 be so sized as to occupy at least 75% of the surface area of face 24. In doing so, and in maintaining the standard dimensions for a sand wedge head or any golf club iron head, it will be understood that the area occupied by insert 32 is now lighter in weight than the metal used in conventional golf club iron heads in the same area. To compensate for this weight reduction, a heavier weight compensator 44 is provided, mounted on the substantially horizontal portion of sole 20 behind face 24. Weight compensator 44 may be formed of a material, such as tungsten, which is heavier for a given volume than is the standard iron or stainless steel used for normal sand wedges whereby weight 44 is able to compensate significantly, if not entirely, for the weight loss by virtue of transparent insert 32. Specifically, the iron or stainless steel portion of face 24 which is lost by virtue of transparent insert 32 may have an approximate weight of 100 grams. The weight of transparent insert 32 may be approximately 15 grams whereby it is desirable to make compensating weight 44 approximately 85 grams. This will return the total weight of head 14, including the weight of insert 32, to approximately 300 grams, and the overall weight of the total club will be approximately 460 grams, corresponding substantially a to standard practice.

It will be noted that although the total weight of head 14 may be adjusted by compensating weight 44 to be substantially equivalent to the standard weights of conventional sand/pitching wedge heads, the position of weight 44 is at the lowest point of head 14 while insert 32 is above the level of weight 44. Accordingly, the center of gravity of head 14 has been lowered as compared to the center of gravity of standard sand wedges. By varying the shape, size and location of weight compensation 44, it is possible to adjust the weight, center of gravity and feel of sand/pitching club 10 to adapt to changing standards, such as featherweight designs. This is a desirable feature of the present invention.

It should also be noted that head 14 may be used without insert 32. While insert 32 is intended to occupy at least 75% of the area of face 24, it is also a feature of the invention that the bottom of face 24, adjacent sole 20, is retained in sufficient height to contact the golf ball and not insert 32 when the club is used properly. Accordingly, the club can well be used without insert 32 as a definite training aid to a golfer who will be forced to make sure that only the bottom portion of the face hits the ball rather than the entire face, since without insert 32 there is little left of the face to be used other than at the sold. It is sufficient for contact with the golf ball if the bottom portion 25 of face 24 be approximately ½" from the bottom of the face to the top of the face, the latter being the bottom edge 30 of U-shaped recess 26.

It will be seen that the invention provides a structure which is particularly suitable for use in sand wedges where a direct substantially vertical line of sight from golfer's eye to the sole and the sand beneath the club is greatly advantageous.

What is claimed is:

1. A golf club head comprising:

a. a heel portion;

b. a sole portion;

c. a toe portion, said heel, sole and toe portions defining a substantially U-shaped recess; and d. a transparent insert, said transparent insert being removably insertable into said U-shaped recess whereby, when inserted, the front of said insert, sole, heel and toe, define the face of said head and a golfer using a golf club including said head can view the playing surface rearward of said sold portion through the front of said transparent insert.

2. A golf club head in accordance with claim 1, wherein:

a. said U-shaped recess has parallel grooves on opposite sides; and b. said transparent insert has parallel side tongues to form a cooperative tongue-and-groove relationship between said insert and said head.

3. A golf club head in accordance with claim 1, wherein said heel, sole and toe, are formed as a single unitary member.

4. A golf club head in accordance with claim 1, additionally comprising:

a. a cover for said head; and b. said head being formed of a plurality of separable elements removably retained by said cover.

5. A golf club head in accordance with claim 1, wherein said cover is transparent in at least the portion covering said transparent insert.

6. A golf club head in accordance with claim 1, wherein a compensating heavy weight is added to said sole to compensate for the weight of the club face area replaced by said transparent insert.

* * * * *